US007264511B2

(12) United States Patent
Asao

(10) Patent No.: US 7,264,511 B2
(45) Date of Patent: Sep. 4, 2007

(54) ELECTRICAL JUNCTION BOX HAVING A SPARE FUSE CONTAINING SECTION

(75) Inventor: Takahiro Asao, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 11/481,029

(22) Filed: Jul. 6, 2006

(65) Prior Publication Data

US 2007/0015382 A1 Jan. 18, 2007

(30) Foreign Application Priority Data

Jul. 14, 2005 (JP) ..... 2005-205876

(51) Int. Cl.
*H01R 13/68* (2006.01)

(52) U.S. Cl. ..... 439/620.27; 439/528

(58) Field of Classification Search ..... 439/620.27, 439/528, 76.2, 718

See application file for complete search history.

(56) References Cited

U.S. PATENT DOCUMENTS 5,662,496 A * 9/1997 Kanamori ..... 439/620.27

FOREIGN PATENT DOCUMENTS

| | | |
|---|---|---|
| JP | Y2-60-10267 | 4/1985 |
| JP | A-6-231672 | 8/1994 |
| JP | U-7-9024 | 2/1995 |
| JP | A-9-245611 | 9/1997 |
| JP | 2005 185009 A * | 7/2005 |

* cited by examiner

*Primary Examiner*—Javaid H. Nasri
(74) *Attorney, Agent, or Firm*—Oliff & Berridge, PLC

(57) ABSTRACT

A spare fuse containing section includes side walls which each include a pair of pinch pieces. The pair of pinch pieces on the side walls clamp an input terminal and output terminal of a low-height fuse. A stopper portion 25 having an H-shaped cross section may project from a bottom wall of the spare fuse containing section. The side walls 21 may also be provided with protrusions that engage stepped portions on a fuse body.

7 Claims, 7 Drawing Sheets

ELECTRICAL JUNCTION BOX HAVING A SPARE FUSE CONTAINING SECTION

This invention relates to an electrical junction box to be mounted on a motor vehicle and having a spare fuse containing section of a simple structure that can accommodate and securely hold a spare fuse, which may be a low-height fuse. This application claims priority from Japanese Patent Application Number JP-2005-205876 filed on Jul. 14, 2005, the entire contents of which are incorporated herein by reference.

BACKGROUND

In the current art, an electrical junction box to be mounted on a motor vehicle contains a fuse to prevent an excessive electrical current from being generated in electrical circuits in the electrical junction box. A spare fuse is attached to a spare fuse containing section in the electrical junction box in order to facilitate replacing a blown fuse with a normal fuse. The spare fuse containing section includes locking pawls projecting from the side walls of the containing section to engage stepped portions on the fuse to securely hold the fuse in the spare fuse containing section.

Recently, a low-height fuse having a substantially parallelepiped configuration (so-called "low-height fuse") has been used in various applications. The low-height fuse includes an input terminal and an output terminal exposed from recesses in each end, respectively, in a fuse body rather than projecting from the bottom of the fuse body (as in a high-height fuse). Consequently, the heights of the side walls of the spare fuse containing section are reduced to accommodate the low-height fuse. Such low height side walls are more difficult to deflect such that, if the locking pawls provided on the low height side walls are relatively long, it may be difficult to forcibly remove the locking pawls from a mold during the junction box molding process. Although it may be easier to remove the junction box from a mold if the locking pawls are made smaller, the locking force is also reduced and the spare fuse is held less securely.

The present applicant has disclosed a spare fuse containing structure provided in an electrical junction box in Japanese Utility Model Public Disclosure No. HEI 7-9024 (JP-U-7-9024). As shown in FIGS. 7A and 7B, this structure accommodates a spare fuse 1 (a "mini-fuse" or "high-height fuse") in which input and output terminals 1*b* project from a bottom surface of a fuse body 1*a*. The input and output terminals 1*b* are pressed into a clearance 2 in a spare fuse containing section. A clearance width is set to be narrower than a thickness of the input and output terminals 1*b*. Locking pieces 3 that project from the spare fuse containing section engage recesses 1*c* in a top end of the fuse body 1*a* to hold the spare fuse 1 in the spare fuse containing section.

SUMMARY

A spare fuse containing section that has no locking pawls can also accommodate a high-height fuse, but could not accommodate a low-height fuse since the fuse body around the input and output terminals cannot be pressed into the narrow clearance of the high-height fuse containing section. Accordingly, the fuse containing section disclosed in JP-U-7-9024 is not suitable for the low-height fuse. Furthermore, the structure disclosed in JP-U-7-9024 lowers workability in fuse insertion, since the locking pieces 3 are deflected during fuse insertion and therefore may be broken.

In view of the above problems, an object of exemplary embodiments of the present invention is to provide an electrical junction box having a spare fuse containing section that can positively hold a low-height spare fuse and has good workability during fuse insertion.

In order to overcome the problems noted above, exemplary embodiments of the present invention provide an electrical junction box having a spare fuse containing section. The spare fuse containing section is adapted to accommodate a low-height fuse that has input and output terminals exposed from recesses formed in two sides of the fuse body. The spare fuse containing section is formed integrally with the upper cover. A pair of sidewalls are formed integrally with the cover. A pair of pinch pieces project from both side walls of the end pieces of the spare fuse containing section. Each pair of pinch pieces clamp the input and output terminals, respectively, of the fuse after fuse insertion.

According to the above construction, it is possible to securely hold the spare fuse in the spare fuse containing section without providing any locking pawls on the side walls of the containing section, since a pair of pinch pieces project from both sides of the walls at each end of the fuse containing section. The input and output terminals of the fuse are inserted into the pair of pinch pieces and they are clamped by the pinch pieces to fix the fuse in the containing section.

Also, workability in fuse insertion can be improved significantly, since the fuse is merely pressed into the spare fuse containing section without deflecting locking pawls.

A stopper portion having an H-shaped cross section may be provided on a central part on a bottom wall of the spare fuse containing section. An inserting side distal end surface of the fuse body contacts the stopper portion when the fuse is fully inserted in the fuse containing section.

According to the above construction, it is possible to hold the fuse in a secure position, without rattling the fuse due to vibrations, not only by supporting the fuse by the pinch pieces but also by contacting the inserting side distal end surface of the fuse body with the top surface of the stopper portion.

The spare fuse containing section also may be provided with a protrusion on each end wall of the fuse containing section adapted to engage a stepped portion on the fuse body.

Although the protrusion is sufficiently small that the molded product can be forcibly removed from the mold during a molding process, it is possible to restrict the fuse from coming out from the containing section due to vibrations or external forces by engaging the protrusion with the stepped portion on the fuse body.

A plurality of spare fuse containing sections may be juxtaposed on the interior of the electrical junction box upper cover and a fuse puller containing section may be formed integrally with the interior of the upper cover for extracting a fuse stored in the spare fuse containing section.

According to the above construction, it is possible to effectively utilize a space on the rear side of the electrical junction box upper cover by juxtaposing a plurality of spare fuse containing sections on the upper cover. It is also possible to readily remove the fuse puller upon inserting or drawing the fuse into or from the spare fuse containing section by arranging the fuse puller containing section adjacent to the spare fuse containing section.

As described above, according to exemplary embodiments of the present invention, it is not necessary to provide any locking pawls on the low-height side walls of the spare fuse containing section, since the pair of pinch pieces project from each side of the end walls of the spare fuse containing section. Each pair of pinch pieces clamp the input and output terminals, respectively, of the fuse on opposite sides of each terminal to fix the fuse in the fuse containing section. Accordingly, it is not necessary to forcibly extract the molded fuse from the mold during a molding process and it is possible to obtain a precise spare fuse containing section.

It is also possible to enhance workability in fuse insertion, since the fuse is merely pressed into the spare fuse containing section without deflecting locking pawls.

Furthermore, it is possible to hold the fuse in position and restrict the fuse from rattling due to vibrations, not only by supporting the fuse by the pinch pieces, but also by contacting the top surface of the stopper portion on the bottom wall of the spare fuse containing section with the inserting side distal end surface of the fuse body.

Also, it is possible to restrict the fuse from coming out from the fuse containing section due to vibrations or external forces by engaging the protrusion with the stepped portion of the fuse body. By forming small protrusions, the molded product can be forcibly removed from the mold during a molding process.

These and other objects, advantages and features are described in or apparent from the following detailed description.

BRIEF DESCRIPTION OF THE DRAWINGS

Exemplary embodiments will be described in connection with the attached drawings, in which like numerals represent like parts, and in which.

DETAILED DESCRIPTION OF EMBODIMENTS

Referring now to FIGS. 1 to 6, various embodiments of an electrical junction box in accordance with the present invention will be described below.

Figure 1:
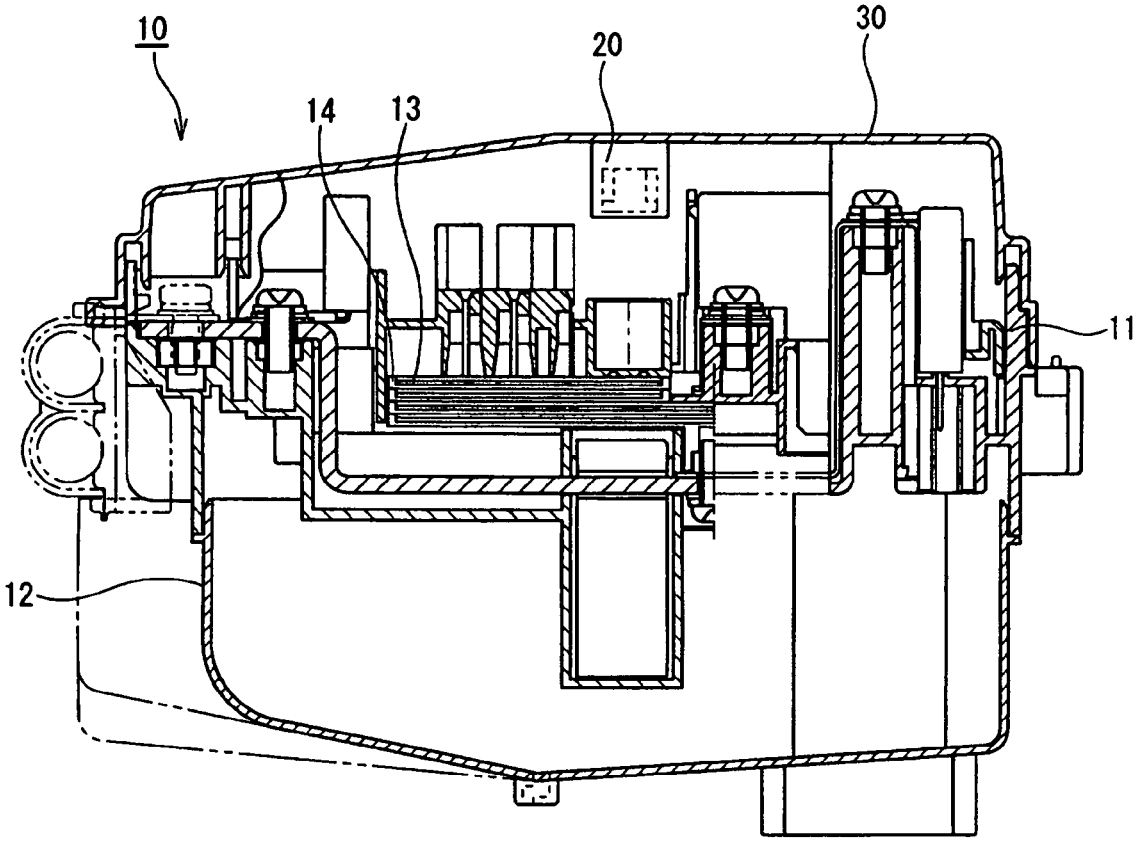
FIG. 1 is a sectional view of an embodiment of an electrical junction box in accordance with the present invention.
Figure 2:
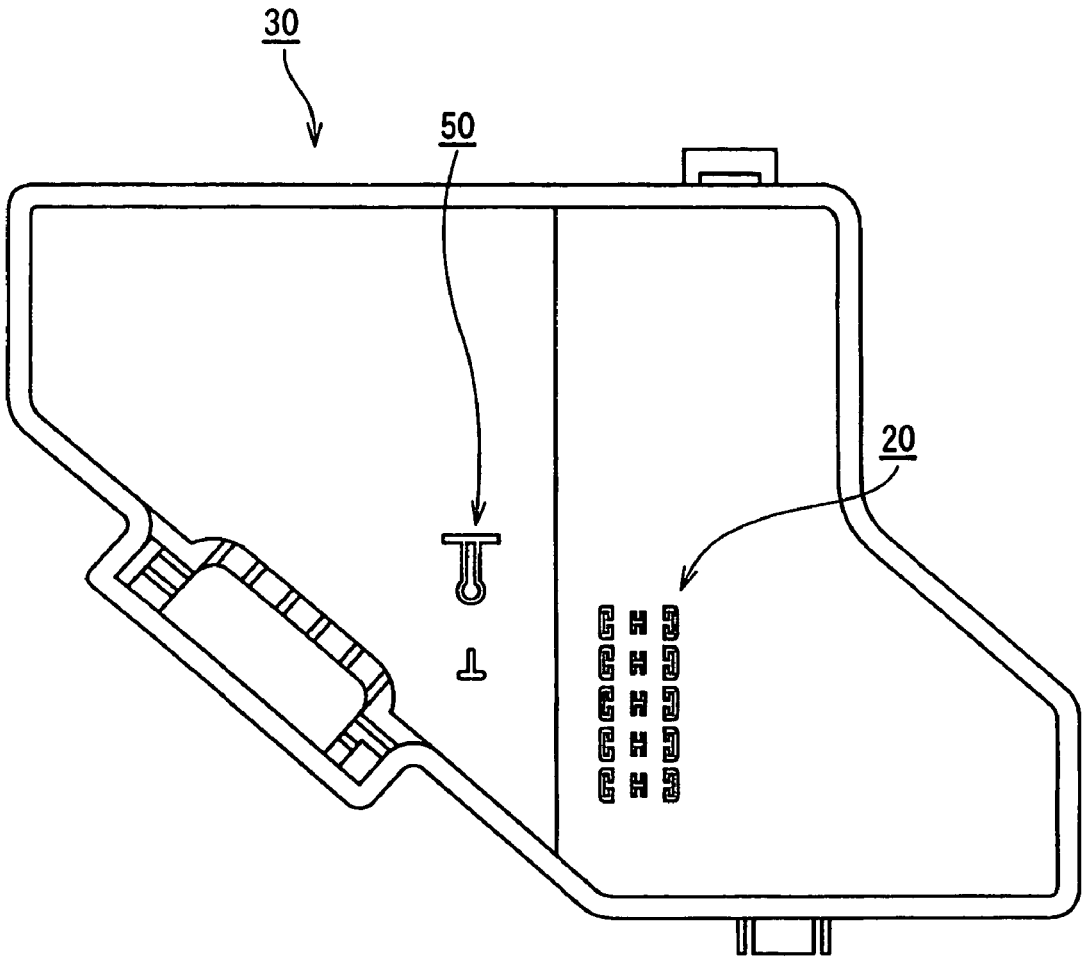
FIG. 2 is a plan view of an upper cover of the electrical junction box, illustrating an interior of the upper cover.
Figure 3A:
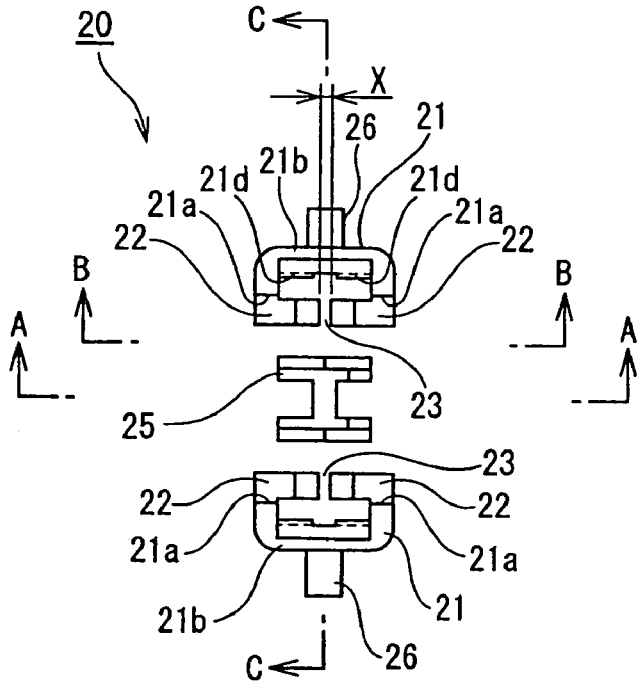
FIG. 3A is a plan view of an embodiment of a spare fuse containing section in accordance with the present invention.
Figure 3B:
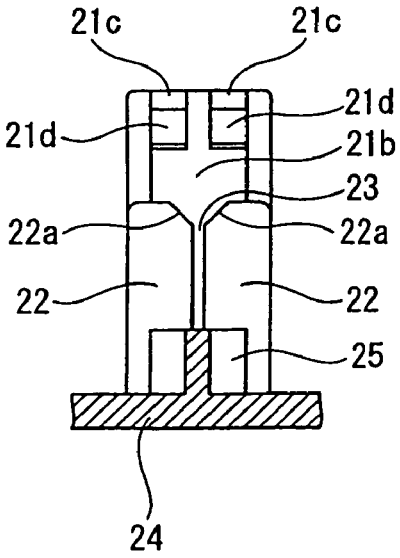
FIG. 3B is a cross section view of the spare fuse section taken along line A-A in FIG. 3A.
Figure 3C:
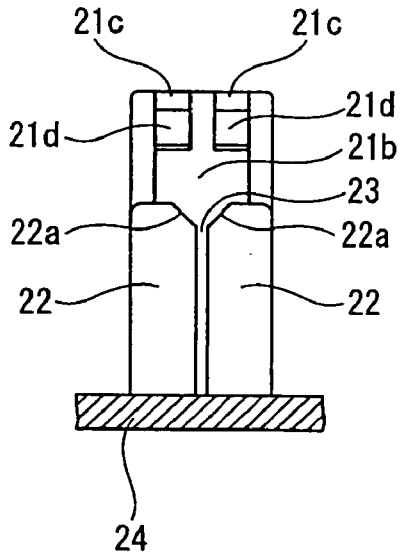
FIG. 3C is a cross section view of the spare fuse section taken along line B-B in FIG. 3A.
Figure 4:
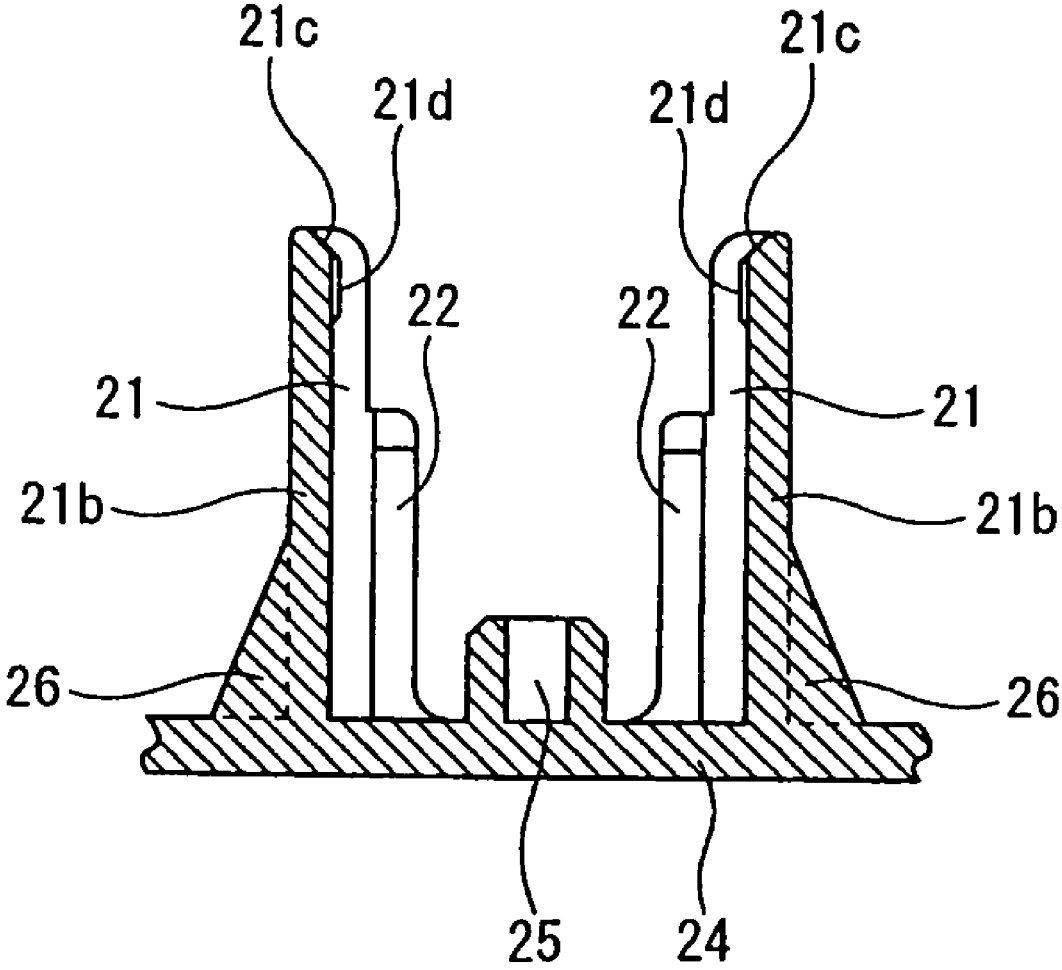
FIG. 4 is a cross section view of the spare fuse section taken along line C-C in FIG. 3A.

FIG. 1 shows an electrical junction box 10 to be mounted on a motor vehicle. FIG. 2 shows an interior of an upper cover 30 of the electrical junction box 10. A plurality of spare fuse containing sections 20 are formed integrally with the upper cover 30 to be arranged in parallel with one another in the cover 30. A fuse puller containing section 50 is formed integrally with the cover 30 near the spare fuse containing sections 20. The fuse puller containing section 50 detachably holds a fuse puller (not shown), which is a jig for removing the fuse.

The electrical junction box 10 includes a casing body 11 (FIG. 1) on which an upper cover 30 and a lower cover 12 are mounted. A laminated body that layers bus bars 13 and insulation plates 14 alternately is contained in the casing body 11. The upper cover 30 is mounted on a top part of the casing body 11. The spare fuse containing sections 20 are provided on the interior of the upper cover 30 so that the sections 20 are arranged above an area where low height components are disposed on the casing body 11. This helps reduce interference between the spare fuse containing sections 20 and the low height components contained in the casing body 11.

Figure 5A:
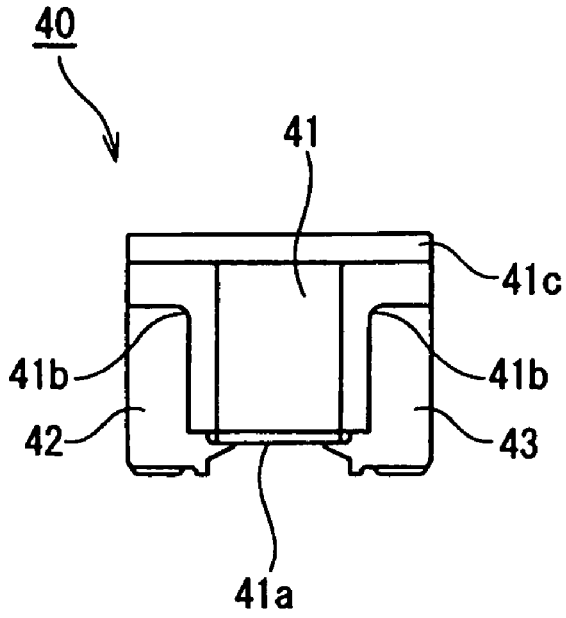
FIG. 5A is a front elevation view of a low-height fuse.
Figure 5B:
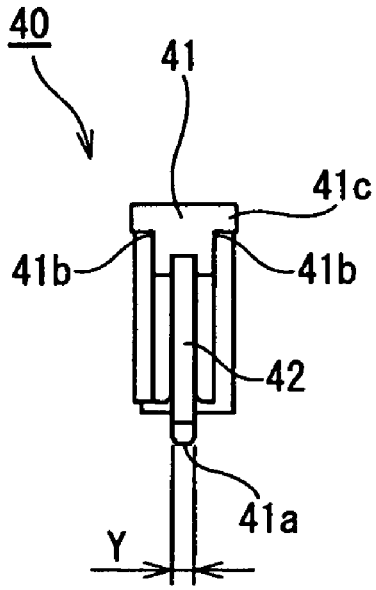
FIG. 5B is a side elevation view of the low-height fuse.

Each spare fuse containing section 20 holds and contains a low height fuse 40 shown in FIGS. 5A and 5B as a spare fuse.

The fuse 40 is formed into a substantially parallelepiped configuration. A fuse element has a fusible portion (not shown) formed between an input terminal 42 and an output terminal 43. The fuse element is embedded in a resin fuse body 41. The fuse body 41 is provided on both sides with recesses 41*b* at each end of the fuse. Each of the input terminal 42 and output terminal 43 are exposed through a recess 41*b*. Since the input and output terminals 42, 43 project a short distance from the lower end of the fuse body 41, the height of the fuse 40 is greatly reduced in comparison with a common minifuse that projects input and output terminals from a lower end of a fuse body.

FIGS. 3A, 3B, 3C and 4 show a structure of a spare fuse containing section 20 formed integrally with the interior of the upper cover 30.

In exemplary embodiments of the invention, a pair of side walls 21 each having a U-shaped cross section are opposed to and spaced away from each other at a given distance on the upper cover 30. Each side wall 21 is provided on the central part with a long connecting portion 21*b*. The long connecting portion 21*b* may be provided on an upper end with an inclined portion 21*c* that is tilted toward a bottom wall 24. A pair of protrusions 21*d* may be provided at the front and rear sides on a lower part of the inclined portion 21*c*. Each protrusion 21*d* may be formed into a slightly stepped configuration.

Two pairs of pinch pieces 22 at the front and rear sides project inward from distal ends of the side portions 21*a* of the side walls 21. A slit 23 is defined between each pair of pinch pieces 22. A width X of the slit 23 is slightly narrower than a thickness Y (see FIG. 5B) of each of the input and output terminals 42, 43 of the fuse 40. Each pinch piece is preferably provided on an upper end with a tapered portion 22*a* so that the input and output terminals 42, 43 of the fuse 40 can be readily inserted.

A stopper portion 25 having an H-shaped cross section, for example, may be provided on a central part on a bottom wall 24 of the spare fuse containing section 20 surrounded by the side walls 21. The stopper portion 25 can contact an inserting side distal end surface 41*a* of the fuse body 41.

The heights of the pinch pieces 22 and stopper portion 25 with respect to the interior of the upper cover 30 are set to a height at which the recesses 41*b* of the fuse 40 contact the pinch pieces 22 when the inserting side distal end surface 41*a* of the fuse 40 contacts the stopper portion 25. A reinforcement rib 26 may be provided between the bottom wall 24 and the outer side of each of the side walls 21.

As shown in FIG. 2, the fuse puller containing section 50 may be formed integrally with the interior of the upper cover 30 and disposed adjacent the spare fuse containing section 20. The fuse puller containing section 50 serves to hold the fuse puller for drawing out the spare fuse accommodated in the fuse containing section 20.

An operation for inserting the fuse 40 into the spare fuse containing section 20 will be explained below.

Figure 6A:
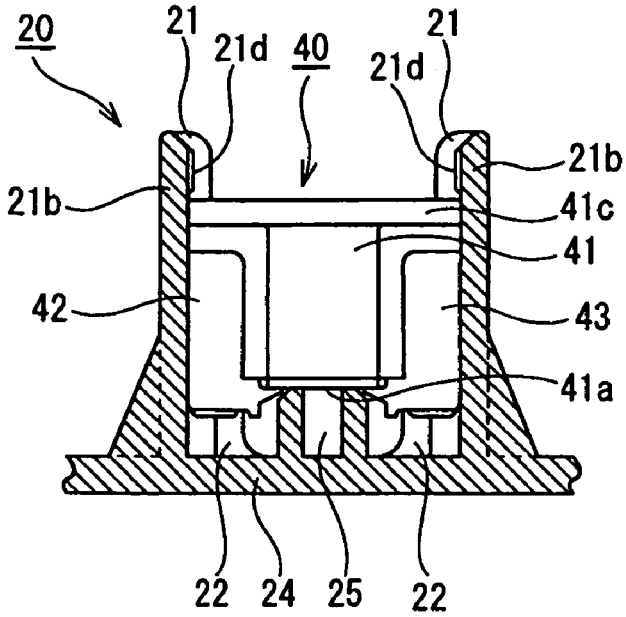
FIG. 6A is a cross section view of the spare fuse containing section according to the present invention, illustrating a spare fuse held in the spare fuse containing section.
Figure 6B:
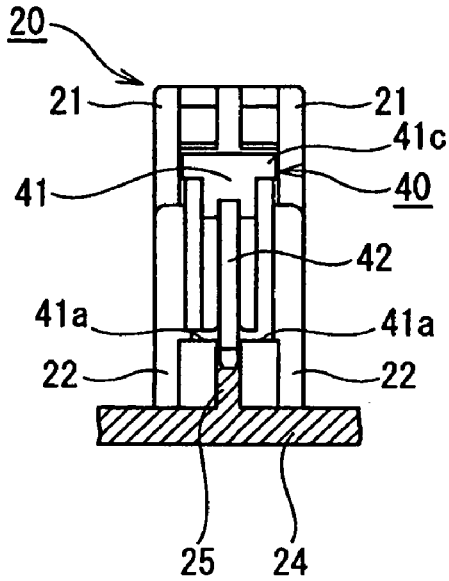
FIG. 6B is a side elevation view of FIG. 6A.
Figure 7A:
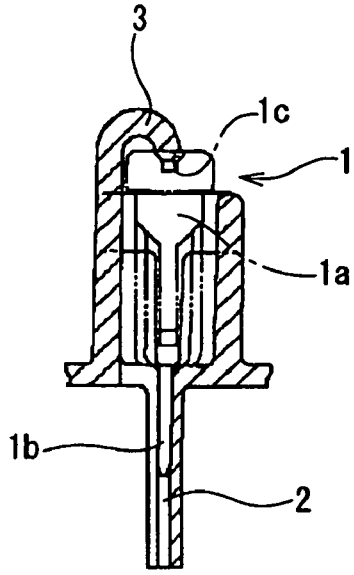
Fig. 7A Prior Art
FIGS. 7A and 7B are sectional views of a conventional spare fuse containing section.
Figure 7B:
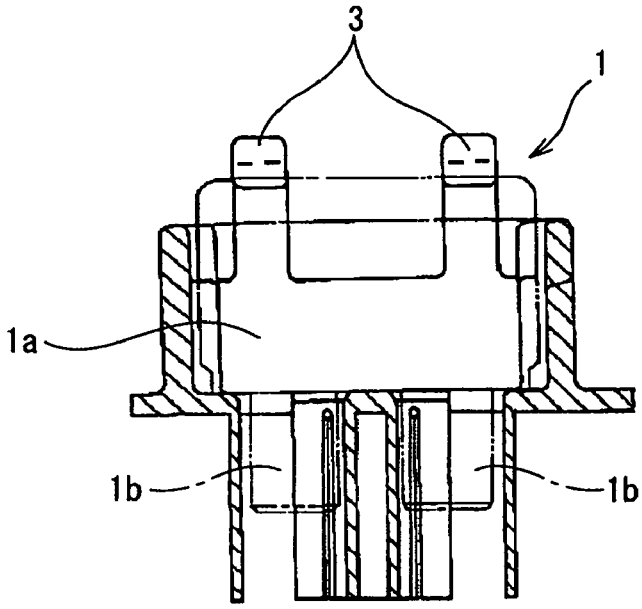
Fig. 7B Prior Art

As shown in FIGS. 6A and 6B, the input and output terminals 42, 43 of the fuse 40 are inserted into the slits 23 in the side walls 21 of the spare fuse containing section 20.

Since the width of the slit 23 is set to be slightly narrower than the thickness of the input and output terminals 42, 43 of the fuse 40, they are clamped by the pinch pieces 22 at the opposite sides when they are inserted into the slits 23. Simultaneously, the stepped portions 41*c* of the fuse body 41 are fitted and moved down into the side walls 21 having the U-shaped configuration. After the stepped portions 41*c* pass over the protrusions 21*d* on the side walls 21 the stepped portions 41*c* are locked by the protrusions 21*d*. The inserting side distal end 41*a* of the fuse body 41 contacts stopper portion 25, is stopped and is securely positioned in the spare fuse containing section 20.

According to the above construction, the input and output terminals 42, 43 of the low height fuse 40 are inserted into the slits 23, the terminals 42, 43 are clamped by the pinch pieces 22 at the opposite sides to securely hold the fuse 40. Accordingly, it is not necessary to provide locking pawls on the side walls 21 of the spare fuse containing section 20 to securely hold the fuse 40 in the spare fuse containing section 20 in the upper cover 30.

It is also possible to hold the fuse in position and to restrict the fuse 40 from rattling due to vibration, not only by holding the fuse 40 by the pinch pieces 22, but also by contacting the inserting side distal end surface 41*a* of the fuse body 41 with the stopper portion 25 on the bottom wall 24. Furthermore, even if the fuse 40 is moved outward, the protrusions 21*d* on the side walls 21 lock the stepped portions 41*c* of the fuse body 41, thereby restricting the fuse 40 from accidentally falling out of the fuse containing section 20, whether by vibration or otherwise.

Although the invention has been described with reference to specific embodiments, these embodiments should be viewed as illustrations and not limiting. Various modifications, substitutions and improvements are possible within the spirit and scope of the invention.

What is claimed is:

1. An electrical junction box having a cover and spare fuse containing section adapted to accommodate a low-height fuse that has input and output terminals exposed from recesses formed in sides of a fuse body and formed integrally with the cover comprising: a pair of side walls formed integrally with the cover; a first pair of pinch pieces projecting from each of the side walls of one end of said spare fuse containing section and a second pair of pinch pieces projecting from each of the side walls of another end of the spare fuse containing section; wherein the first pair of pinch pieces clamp the input terminal of the fuse and the second pair of pinch pieces clamp the output terminal of the fuse, wherein a stopper portion projects from a central part of a bottom wall of the spare fuse containing section and an inserting side distal end surface of the fuse body contacts with the stopping portion, wherein the stopper portion having an H-shaped cross section.

2. An electrical junction box having a spare fuse containing section according to claim 1, wherein the spare fuse containing section is provided with a protrusion on each of the side walls, the protrusions adapted to engage a stepped portion on the fuse body.

3. An electrical junction box having a spare fuse containing section according to claim 2, wherein the spare fuse containing section comprises a plurality of spare fuse containing sections, the plurality of spare fuse containing sections are juxtaposed on the interior of the cover, and a fuse puller containing section is formed integrally with the interior of said cover for extracting a fuse accommodated in said spare fuse containing section.

4. An electrical junction box having a spare fuse containing section according to claim 1, wherein the spare fuse containing section is provided with a protrusion on each of the side walls, the protrusions adapted to engage a stepped portion on the fuse body.

5. An electrical junction box having a spare fuse containing section according to claim 4, wherein the spare fuse containing section comprises a plurality of spare fuse containing sections, the plurality of spare fuse containing sections are juxtaposed on the interior of the cover, and a fuse puller containing section is formed integrally with the interior of said cover for extracting a fuse accommodated in said spare fuse containing section.

6. An electrical junction box having a spare fuse containing section according to claim 1, wherein the spare fuse containing section comprises a plurality of spare fuse containing sections, the plurality of spare fuse containing sections are juxtaposed on the interior of said cover and a fuse puller containing section is formed integrally with the interior of said cover for extracting a fuse accommodated in said spare fuse containing section.

7. An electrical junction box having a spare fuse containing section according to claim 1, wherein the spare fuse containing section comprises a plurality of spare fuse containing sections, the plurality of spare fuse containing sections are juxtaposed on the interior of the cover, and a fuse puller containing section is formed integrally with the interior of said cover for extracting a fuse accommodated in said spare fuse containing section.

* * * * *